US005472742A

United States Patent [19]

Lee

[11] Patent Number: 5,472,742

[45] Date of Patent: Dec. 5, 1995

[54] METHOD FOR ACTIVATING CARBON FIBER SURFACES

[75] Inventor: Ronald N. Lee, Silver Spring, Md.

[73] Assignee: The United States of America as represented by the Secretary of the Navy, Washington, D.C.

[21] Appl. No.: 313,967

[22] Filed: Sep. 28, 1994

[51] Int. Cl.[6] ..... B05D 3/00; B05D 3/10; D02G 3/00

[52] U.S. Cl. ..... 427/399; 427/343; 428/375; 423/447.1

[58] Field of Search ..... 427/399, 307, 427/343, 322, 434.2, 434.6, 444, 341, 343; 423/439, 447.1, 447.4, 341; 428/375

[56] References Cited

U.S. PATENT DOCUMENTS 3,989,802 11/1976 Joo et al. ..... 423/447.1

4,686,096 8/1987 Schulz et al. ..... 423/447.1

FOREIGN PATENT DOCUMENTS 1238308 7/1971 United Kingdom ..... 423/447.1

OTHER PUBLICATIONS

Donnet, J. B. *Carbon,* 20(#4), 1982, pp. 267–282.

"*Carbon Fibers*", by J. B. Donnet & R. C. Baneal, Marcel Dekker Inc. New York, N.Y. 1984, pp. 124–131.

*Primary Examiner*—Shrive Beck
*Assistant Examiner*—Fred J. Parker
*Attorney, Agent, or Firm*—Charles D. Miller

[57] ABSTRACT

Carbon fibers are reacted with an oxidative solution of the type that produces graphitic oxide on the graphitic basal plane without forming significant quantities of graphitic oxides and the treated carbon fibers are then reacted with an oxidative solution of the type that produces $CO_2$ at edge-plane sites such that active bonding sites on surfaces of the carbon fibers are maximized.

20 Claims, No Drawings

METHOD FOR ACTIVATING CARBON FIBER SURFACES

This invention was made with Government support by the Naval Surface Warfare Center. The Government has certain rights in this invention.

BACKGROUND OF THE INVENTION

1. Field of the Invention

The present invention relates to a method for treating carbon fibers and, in particular, to a method for producing chemically active centers on surfaces of carbon fibers.

2. Brief Description of the Prior Art

Prior art composite materials that are reinforced with carbon fibers do not provide the desired mechanical properties because a sufficiently strong interface between the fibers and the matrix material is lacking. Known methods for improving the interface strengths concentrate on modifying the fiber surfaces through application of coatings, or through the treatment of the fibers with oxidative solutions that include an active oxidant. However, the beneficial effects of the oxidative treatments are not certain. It is believed that oxidation improves the interface strength by increasing the fiber surface area; by depositing chemical functionalities on the fiber surface, which increase the strength of the individual chemical bonds with the matrix; and by removing defects from the fiber surface. However, the mechanisms by which oxidative treatments improve interfaces and why the improvements are not as great as desired have been matters of controversy.

Moreover, while it is known that exposed surfaces of carbon fibers are basal plane graphite, the structural and chemical properties associated with the basal plane nature of the fiber surfaces have not been utilized for producing active centers on the surfaces of the carbon fibers.

According to J. B. Donnet, Carbon 20, 267 (1982), all oxidative solutions fall either into the class of graphitic oxide formers (i.e., solutions of the type that produce graphitic oxide), which preferentially attack the graphitic basal plane surface, or into the class of $CO_2$ formers (i.e., solutions of the type that produce $CO_2$), which preferentially attack the edges of the basal planes. Typically, the oxidative solutions that have been used for surface treatments are members of the class of $CO_2$ formers. However, such solutions have no effect on the basal plane areas of the fibers where bonding sites are absent. The principle mechanism by which the conventional fiber treatment reagent improves interface strength is by decreasing the size of the inert basal plane domains through erosion of the domain edges. This is a highly inefficient mechanism whose benefits are strongly limited by the degradation that accompanies this type of surface structure modification. Consequently, the expected interface strengths have not been achievable by this type of oxidation treatment. Also, since the number of native edge sites decreases with fiber modulus, the beneficial effects of conventional oxidation treatments diminish with fiber modulus. In the very high modulus range, where the interface problem is most severe, conventional oxidative treatments provide little or no benefit.

Although the class of oxidative solutions that form graphitic oxide on the basal plane preferentially attacks the basal plane surface, these solutions are infrequently used in the treatment of carbon fibers. The present inventor has surprisingly found that the chemical disruption of basal plane areas by graphitic oxide formers produces chemically active sites precisely where they are needed on carbon fiber surfaces.

In the few cases where carbon fiber treatments with these reagents have been reported the oxidative solutions were not used in a way that was appropriate to the controlled activating of the fiber surface. The oxidation reaction was allowed to go to the point of graphitic oxide formation and attention was focussed on the nature of the chemical functionalities that the reaction produced on the surface. Fabrication of composites with such fibers produced improved interface properties, but the presence of the graphitic oxide leaves a great deal of uncertainty as to the mechanism of the improvement. In no case has an oxidative solution been used to chemically activate the inert basal plane areas of carbon fiber surfaces without the formation of significant quantities of graphitic oxide. Also graphitic oxide formers have not been previously used with $CO_2$ formers in a manner so that the chemically active sites formed are maximized.

SUMMARY OF THE INVENTION

An object of the present invention is to modify carbon fiber surfaces so as to create chemical bonding sites on the otherwise inert graphitic basal plane areas of the fiber surfaces.

Another object of the present invention is to strengthen the interfaces between carbon fibers and matrix materials in composite materials by increasing the number of matrix-fiber bonds and by reducing the stress concentrations at the interfaces through the development of a more uniform distribution of bonding sites over the fiber surfaces.

Yet another object of the present invention is to increase and homogenize the surface free energy of the fibers as a means of promoting fiber wetting and infiltration of fiber yarns by matrix materials.

The above and other objects of the present invention are achieved by providing the methods described herein and the resulting carbon fibers.

In one aspect, the invention provides a method for producing active chemical sites on carbon fiber surfaces, comprising the steps of: reacting carbon fibers with a graphitic oxide former; stopping the reaction before formation of significant quantities of graphitic oxide on surfaces of the carbon fibers; and then reacting the carbon fibers with a $CO_2$ former.

In another aspect, the invention provides a method for producing active sites on carbon fiber surfaces, comprising the steps of: reacting carbon fibers with a graphitic oxide former; stopping the reaction before graphitic oxide has formed on 5% of the surface area of the carbon fibers; rinsing the carbon fibers; and then reacting the carbon fibers with a $CO_2$ former.

As used herein, graphitic oxide formers and $CO_2$ formers are oxidative solutions that include an active oxidant in solution.

Other features and advantages of the present invention will become apparent from the following description of the invention.

DETAILED DESCRIPTION OF PREFERRED EMBODIMENTS OF THE INVENTION

Although not limited, it is envisioned that the process is carried out on as-spun yarns of carbon fibers, which have not been previously subjected to any surface treatment nor coated with a "sizing" or any other material. The process could be integrated into a continuous fiber manufacturing line as a treatment step that immediately follows fiber cool-down and is prior to fiber sizing and/or spooling. After treatment with the process of the invention, the carbon fibers could be used in known processes, such as fabrication of composites by combining the carbon fibers with matrix materials.

The process consists of five steps: 1) immersion of the carbon fibers in an oxidative solution of the type that produces graphitic oxide on the graphitic basal plane (hereinafter graphitic oxide former); 2) rinsing of the carbon fibers to stop the reaction and remove residual reagent; 3) immersion of the carbon fibers in an oxidative solution of the type that produces $CO_2$ at edge sites of the basal plane (hereinafter $CO_2$ former); 4) rinsing of the carbon fibers to stop the reaction and remove residual reagent; and 5) drying of the fibers.

Step 1 of the process can be carried out using any oxidative solution in the class of solutions which produce graphitic oxide. These oxidative solutions include an active oxidant in solution. Without being bound by theory, Step 1 produces a low density of defects on the perfect graphitic basal plane areas of the fiber surface without forming significant quantities of graphitic oxide. The duration of the immersion, the temperature of the oxidative solution and the concentration of the oxidative solution are the controlling parameters for this step and will depend on the specific oxidative solution that is used. One of the best known oxidative solutions in this class is Hummer's reagent: $KMnO_4$ in $H_2SO_4$. There is also a family of oxidative solutions in the class of graphitic oxide formers that consists of a solution of an oxidant in $H_2SO_4$ and $HNO_3$. Suitable oxidants for use in such solutions include $CrO_3$, $KMnO_4$, $(NH_4)_2S_2O_8$, $MnO_2$, $PbO_2$, $As_2O_5$ and $K_2C10_3$. Many other oxidative solutions, such as $KMnO_4$ in KOH and chromic acid, also produce graphitic oxide and no attempt is made here to compile an exhaustive list of oxidative solution in the class of graphitic oxide formers.

At a given temperature, there can be considerable differences between the reaction rates of oxidative solutions in the class of graphitic oxide formers. For example, the reaction rates of the last two mentioned oxidative solutions differ by two orders of magnitude at 100° C. With adjustments of temperature to accommodate the reaction rate of the specific oxidative solution being used, the immersion time is adjusted to produce maximum reaction below the point of formation of significant quantities of graphitic oxide.

It is envisioned that the immersion time could be as low as 10 seconds. Preferably, the immersion time would range from about 1 minute to about 10 minutes. The point of formation of significant quantities of graphitic oxide is the point at which graphitic oxide has formed on about 5% of the surface area of the carbon fibers. Preferably, the reaction time is adjusted to produce graphitic oxide on less than 1% of the surface area of the carbon fibers.

The optimum reaction time for Step 1 can be systematically determined for any oxidative solution by using a suitable analytical technique to determine the onset of graphitic oxide formation. X-ray photoelectron spectroscopy (XPS), for example, can be used to analyze fibers as a function of the time that they are subjected to the oxidative solution of Step 1. The width, energy and lineshape of the carbon is line will indicate the extent of active site production on the basal plane areas of the fiber surfaces. Without being bound by theory, it is believed that Step 1 preferentially creates chemically active sites (defects) in precisely those regions where no bonding sites exist on the as-manufactured fiber. Accordingly, Step 1 is a key step in that it both increases the number of bonding sites and distributes bonding sites more uniformly over the fiber surfaces.

Step 2 of the process quenches or terminates the reaction of Step 1 and removes the residual oxidative solution remaining in the carbon fibers to prevent carry-over into the bath for Step 3. A water bath may be used with the immersion time and the replenishment rate adjusted to eliminate reagent carry-over.

Step 3 develops the basal plane defects produced in Step 1 into a higher density of chemically active sites by etching with any solution that is a member of the class of C02-producing oxidative solution. These oxidative solutions include an active oxidant in solution. Since this class of oxidative solutions preferentially attacks edge sites, point defects formed in the basal plane areas by Step 1 provide reaction sites in the basal plane surface where the Step 3 oxidative solution removes atoms from the plane. Step 3 oxidation thus creates circular monatomic steps, which are centered on the site of the original defect and whose radius depends on the reaction rate and the duration of the oxidation reaction. Step 3 of the process multiplies the number of chemical bonding sites established in Step 1 by a factor proportional to the radius of the circles etched around the defects. Any oxidative solution, such as nitric acid in solution, which is a member of the class of $CO_2$ formers can serve this function and this fact provides a great deal of flexibility in the overall process. For example, many proprietary oxidative solutions of this class have been developed which saturate the active sites with chemical functionalities that promote bonding to specific polymer matrix materials. The generic nature of the process described here allows such proprietary oxidative solutions to be used in Step 3 and thus retain the proven benefits of oxidative solutions that are currently in use. However, the preparation of the fiber surface by Step 1 greatly increases the effectiveness of such proprietary oxidative solutions and extends their action to the basal plane areas of the fibers where they normally have no effect at all.

The process described here extends the effectiveness of existing fiber surface treatments to fibers in the very high modulus range. Since the very high modulus fiber surfaces are almost entirely perfect basal planes, conventional oxidative solutions have few edge sites to attack and have been almost completely ineffective. With the pretreatment of Step 1, however, high modulus fibers become reactive enough to benefit from the action of conventional oxidative solutions. The parameters for Step 3 depend on the particular oxidative solution chosen and will be nominally the same as those normally used for conventional oxidation treatments as described in the literature or practiced in proprietary processes.

However, unlike previous use of $CO_2$ formers, in the process of the present invention the $CO_2$ formers are combined with the graphitic oxide formers to maximize the bonding surfaces thereby optimizing the bonding between the carbon fibers and the matrix with which the carbon fibers are combined to form a composite. The parameters for Step 3 are chosen with the goal of maximizing, i.e. optimizing, the bonding between the carbon fibers and the matrix. A precaution to be taken is against over treatment of the carbon fibers, which could result in degradation of the structure of the fibers. Accordingly, the modulus of the fiber and the structure of the fiber are important for Step 3.

Step 4 removes residual reagent from the fiber surfaces. A water bath could be sufficient but multiple, successive baths may be necessary to ensure that no reagent remains which might chemically degrade the composite interface.

Drying of the fibers in Step 5 may be accomplished with an air furnace. Preferably, the drying temperature has an upper temperature limit of approximately 1500° C. A higher temperature could undesirably effect the chemically active sites. Preferably, a lower temperature limit is selected at which all water is driven off. Other suitable upper temperature limits may be selected based upon the need to preserve chemical functionalities deposited on the fiber in Step 3.

After drying the fibers in Step 5, the treated carbon fibers may be used for any desirable or suitable purpose. For example, the carbon fibers may be used as reinforcement in composites by combining the treated fibers with suitable matrix materials.

It has been determined that the basal plane surface structure inherent to carbon fibers is responsible for the premature failure of carbon fiber reinforced composite interfaces. X-ray photoelectron spectra of carbon fibers were used to count the number of oxygen atoms, and hence the number of surface bonding sites, on the fiber surface as a function of the longitudinal Young's modulus of the fiber. It was found that the number of bonding sites decreases with increasing modulus in exactly the same way as interface strengths decrease with modulus. To the knowledge of the inventor, this was the first time that any experimental correlation had been established between interface strengths and a surface property inherent to carbon fibers. Subsequent experiments utilizing the angular dependence of photoelectron emission established that bonding sites exist solely at steps, or edge-plane sites, on the fiber surface and that no bonding at all occurs on the basal plane areas. This finding was consistent with the fact that the graphitic basal plane is almost completely inert in the absence of lattice defects and that the thermal history of carbon fiber manufacture is such as to completely eliminate any defects on the basal plane areas of the fiber surface. These experiments showed that the areas of the basal plane domains, or platelets, on the fiber surface increase with increasing modulus. Since bonding can only occur at the edges of these domains, the number of binding sites on the surface decreases with increasing fiber modulus. Furthermore, the small number of binding sites that do exist on the fiber surface are all concentrated along a network of lines defined by the edges of the basal plane domains. In the composite, this means that there is no chemical bonding at all on most of the interfacial area. All load is transferred from matrix to fiber along a network of stress concentrations at the basal plane domain edges where the chemical bonds are located. These stress concentration points, in fact, correspond to the weakest points on the fiber surface due to the tendency of graphite to delaminate. In summary, the fundamental reason that interfaces in carbon fiber reinforced composites are weak is that the inherent surface structure of carbon fibers severely restricts the number of chemical bonding sites on the fiber and localizes them into a stress-concentration network at the weakest points on the fiber.

The process disclosed herein is the only chemical treatment known to the inventor that is specifically designed to exploit these structural-chemical surface properties of carbon fibers. The following features are new to the art of fiber surface modification:

1. An oxidative solution from the class of graphitic-oxide-forming oxidative solutions is used to prepare the fiber surface for subsequent oxidation.

2. The initial oxidation reaction is controlled to create chemically active defects rather than to form graphitic oxide.

3. The initial oxidation reaction creates chemically active sites specifically on the basal plane areas of the fiber surface where bonding cannot otherwise take place.

4. The initial oxidation reaction affects only the chemically passive areas of the fiber surface and does not degrade the fiber by secondary reactions.

5. The final oxidation reaction develops multiple chemically active bonding sites from each active center created in the initial oxidation.

The advantages of the invention over prior art include the following:

1. The fiber treatment process produces stronger interfaces in composite materials than the prior art by producing chemically active centers on the passive areas of the fiber, thereby reducing the stress concentrations associated with large, unbonded fiber surface areas. Oxidative treatments of the prior art do not produce bonding sites on these passive areas.

2. The fiber treatment process produces stronger interfaces in composite materials than the prior art due to the larger total number of bonding sites produced on the fiber surface.

3. The effectiveness of the process increases with increasing fiber modulus, whereas oxidative treatments of the prior art have little or no effect on very high modulus fibers.

4. Treated fibers have a higher surface free energy and more homogeneous distribution of energetic surface sites than obtainable with the prior art, thus improving the ability of matrix materials to wet the fibers and infiltrate fiber yarns. This advantage may lead to the elimination of expensive composite manufacturing steps and permit the manufacture of near-net-shape composites from fiber lay ups using matrix materials for which this was not previously possible.

5. The final oxidation reaction requirements are consistent with the use of oxidative solutions employed in the prior art of fiber surface modification.

6. The benefits of the new process are additive with any benefits of prior art processes used in the final oxidation.

The invention is a generic one which, in principle, can be implemented using any of the graphitic-oxide-producing oxidative solutions for the initial oxidation and any of the $CO_2$-producing oxidative solutions for the final oxidation without in any way departing from the spirit and scope of the invention. In addition, variations to the process could be implemented which, while offering added benefits, would not depart from the spirit and scope of the invention. For example, a greater density of bonding sites could be developed on fibers by subjecting the fibers to multiple oxidation treatments. This would overcome any limitation imposed by the formation of graphitic oxide on the number of active sites produced in a single treatment. Alternatively, graphitic oxide growth could be inhibited by interrupting the preliminary oxidation periodically to clean the fiber surface. Any fiber treatment process employing such variations remains within the scope of the invention as long as it retains the essential features of creating active centers on passive fiber surface areas with a graphitic-oxide-producing oxidative solution and developing these active centers into multiple bonding sites with a $CO_2$-producing oxidative solution.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for producing active chemical sites on carbon fiber surfaces, comprising the steps of: reacting carbon fibers with a graphitic oxide former; stopping the reaction before graphitic oxide forms on about 5% of the surfaces of the carbon fibers; and then reacting the carbon fibers with a $CO_2$ former.

2. The method of claim 1, wherein the carbon fibers are reacted with the graphitic oxide former by immersing the carbon fibers into said graphitic oxide former.

3. The method of claim 1, wherein the carbon fibers are reacted with the $CO_2$ former by immersing the carbon fibers into said $CO_2$ former.

4. The method of claim 1, further comprising a first rinsing step after the reaction of the carbon fibers with the graphitic oxide former and a second rinsing step after the reaction of the carbon fibers with the $CO_2$ former.

5. The method of claim 1, wherein the graphitic oxide former is selected from the group consisting of $KMnO_4$ in $H_2SO_4$, $KMnO_4$ in KOH and chromic acid, and an oxidant in an acid bath of $H_2SO_4$ and $HNO_3$.

6. The method of claim 1, wherein the graphitic oxide former comprises an oxidant selected from the group consisting of $CrO_3$, $KMnO_4$, $(NH_4)_2S_2O_8$, $MnO_2$, $PbO_2$, $As_2O_5$ and $K_2C10_3$.

7. The method of claim 1, wherein the carbon fibers are reacted with the graphitic oxide former for at least 10 seconds.

8. The method of claim 7, wherein the carbon fibers are reacted with the graphitic oxide former for a time period within the range of 1 minute to 10 minutes.

9. The method of claim 1, wherein the reaction of the carbon fibers with the graphitic oxide former is terminated at a time at which graphitic oxide has formed on less than 5% of the surface area of the carbon fibers.

10. The method of claim 9, wherein the reaction of the carbon fibers with the graphitic oxide former is terminated at the time at which graphitic oxide has formed on less than about 1% of the surface area of the carbon fibers.

11. The method of claim 1, further comprising the step of drying the carbon fibers after reacting the carbon fibers with the $CO_2$ former.

12. The method of claim 11, wherein the drying is carried out at a temperature less than about 1500° C.

13. The method of claim 1, wherein the $CO_2$ former comprises nitric acid.

14. A method for producing active sites on carbon fiber surfaces, comprising the steps of: reacting carbon fibers with a graphitic oxide former; stopping the reaction before graphitic oxide has formed about on 5% of the surface area of the carbon fibers; and then reacting the carbon fibers with a $CO_2$ former.

15. The method of claim 14, wherein the graphitic oxide former comprises an oxidant selected from the group consisting of $CrO_3$, $KMnO_4$, $(NH_4)_2S_2O_8$, $MnO_2$, $PbO_2$, $As_2O_5$ and $K_2C10_3$.

16. The method of claim 14, further comprising a rinsing step after the reaction of the carbon fibers with the $C_2$ former.

17. The method of claim 14, wherein the carbon fibers are reacted with the graphitic oxide former for at least 10 seconds.

18. The method of claim 17, wherein the carbon fibers are reacted with the graphitic oxide former for a time period within the range of 1 minute to 10 minutes.

19. A carbon fiber formable by the method of claim 1.

20. A carbon fiber formable by the method of claim 14.

* * * * *